US008282852B2

(12) United States Patent
Marur

(10) Patent No.: US 8,282,852 B2
(45) Date of Patent: Oct. 9, 2012

(54) MAGNETORHEOLOGICAL FLUID AND METHOD OF MAKING THE SAME

(75) Inventor: Prabhakar Marur, Bangalore (IN)

(73) Assignee: GM Global Technology Operations LLC, Detroit, MI (US)

( * ) Notice: Subject to any disclaimer, the term of this patent is extended or adjusted under 35 U.S.C. 154(b) by 97 days.

(21) Appl. No.: 12/560,472

(22) Filed: Sep. 16, 2009

(65) Prior Publication Data

US 2011/0062371 A1 Mar. 17, 2011

(51) Int. Cl.
*H01F 1/00* (2006.01)

(52) U.S. Cl. ..... 252/62.54; 252/62.51 R; 252/62.56

(58) Field of Classification Search ..... None
See application file for complete search history.

(56) References Cited

U.S. PATENT DOCUMENTS

| | | | | |
|---|---|---|---|---|
| 4,957,644 | A | 9/1990 | Price et al. | |
| 5,167,850 | A * | 12/1992 | Shtarkman | 252/62.52 |
| 5,505,880 | A | 4/1996 | Kormann et al. | |
| 5,549,837 | A * | 8/1996 | Ginder et al. | 252/62.52 |
| 5,578,238 | A | 11/1996 | Weiss et al. | |
| 6,103,379 | A | 8/2000 | Margel et al. | |
| 6,787,058 | B2 | 9/2004 | Foister et al. | |
| 6,875,368 | B2 | 4/2005 | John et al. | |
| 7,105,144 | B2 | 9/2006 | Kato | |

FOREIGN PATENT DOCUMENTS

EP 0406692 A2 1/1991

OTHER PUBLICATIONS

International Search Report dated May 25, 2011 for International Application No. PCT/US2010/049122.
Written Opinion of the International Searching Authority dated May 25, 2011 for International Application No. PCT/US2010/049122.
International Preliminary Report on Patentability mailed on Mar. 29, 2010 for International Application No. PCT/US2010/049122 filed on Sep. 16, 2010.

* cited by examiner

*Primary Examiner* — Emily Le
*Assistant Examiner* — Sarah A Slifka
(74) *Attorney, Agent, or Firm* — Cantor Colburn LLP

(57) ABSTRACT

A magnetorheological (MR) fluid is described herein. The MR fluid includes a plurality of magnetizable particles having a particle density. The fluid also includes a carrier fluid having a fluid density, and the plurality of magnetizable particles is dispersed within the carrier fluid. A portion of the plurality of magnetizable particles has a particle density that is substantially the same as the fluid density. The MR fluid may include a plurality of magnetizable particles having an outer shell of a magnetizable material and a hollow core. The MR fluid may also include a plurality of magnetizable particles having an outer shell of a magnetizable material and a solid core. The MR fluid may include a plurality of magnetizable particles having a matrix and a plurality of sub-particles embedded therein. The core or matrix of these particles may include a ceramic, glass or polymer, or a combination thereof. The magnetizable material may include magnetizable metals, metal alloys and various ferrites, such as those comprising Co, Fe, Mg, Mn, Ni, or Zn, or a combination thereof.

20 Claims, 3 Drawing Sheets

MAGNETORHEOLOGICAL FLUID AND METHOD OF MAKING THE SAME

FIELD OF THE INVENTION

Exemplary embodiments of the present invention are related to magnetorheological fluids and, more specifically, to a magnetorheological fluid comprising magnetic particles having a density that is matched to the density of the fluid.

BACKGROUND

A magnetorheological (MR) fluid is a fluid with micron-sized magnetic particles that is configured to change viscosity almost instantaneously when subjected to a magnetic field. A typical MR fluid in the absence of a magnetic field has a readily measurable viscosity that is a function of its fluid components and particle composition, particle size, the particle loading, temperature and the like. However, in the presence of an applied magnetic field, the suspended particles appear to align or cluster and the fluid drastically thickens or gels. Its effective viscosity then is very high and a larger force, termed a yield stress, is required to promote flow in the fluid. The viscosity of the MR fluid increases to the point of becoming a viscoelastic solid by application of magnetic fields.

MR fluids exhibit an ability to change their rheology, and thus their flow characteristics, by several orders of magnitude in a timeframe on the order of milliseconds under the influence of an applied magnetic field. The induced rheological changes are completely reversible and, hence, can be utilized in devices that respond to the changes in the magnetic field environment. The utility of these materials is that suitably configured electromechanical actuators which use magnetorheological fluids can act as a rapidly responding active interface between computer-based sensing or controls and a desired mechanical output. With respect to automotive applications, such materials are seen as a useful working media in shock absorbers, for controllable suspension systems, vibration dampers in controllable powertrain and engine mounts and in numerous electronically controlled force/torque transfer (clutch) devices. MR fluids offer significant advantages over other controllable fluids, such as ER fluids, particularly for automotive applications, because the MR fluids are generally less sensitive to common contaminants found in such environments, and they display greater differences in rheological properties in the presence of a modest applied field. The rheological properties of the carrier fluid, and the size and density of the suspended magnetic particles, define the important fluid characteristics, such as the settling rate, in devices that utilize MR fluids. Settling of the particles in an MR fluid significantly diminishes the performance of the fluid in the magnetized state, i.e., upon application of a magnetic field.

MR fluids are generally noncolloidal suspensions of finely divided (typically one to 100 micron diameter) low coercivity, magnetizable solids such as iron, nickel, cobalt, and their magnetic alloys dispersed in a base carrier liquid such as a mineral oil, synthetic hydrocarbon, water, silicone oil, esterified fatty acid or other suitable organic liquid. MR fluids have an acceptably low viscosity in the absence of a magnetic field but display large increases in their dynamic yield stress when they are subjected to a suitable magnetic field of, for example, about one Tesla. Since MR fluids contain noncolloidal solid particles which are often seven to eight times denser than the liquid phase in which they are suspended, suitable dispersions of the particles in the liquid phase must be prepared so that the particles do not settle appreciably upon standing nor do they irreversibly coagulate to form aggregates.

The magnetizable particles are kept in suspension, i.e., from settling, by dispersing a thixotropic agent, such as fumed or precipitated silica. Silicas stabilize the MR fluid by forming a network through hydrogen bonding between silica particles. This network breaks down under shear and reforms upon cessation of shear to keep the magnetizable particles suspended while exhibiting low viscosity under shear. Precipitated silica typically has a large particle size and low surface area due to its method of formation, whereas fumed silicas are typically smaller in size with larger surface area. Fumed silicas, when used, are typically surface treated. Both precipitated silicas and treated fumed silicas, however, often exhibit poor network formation, and consequently low yield stresses in the MR fluid during operation.

MR fluids may additionally contain surfactants to prevent coagulation and settling of the magnetizable particles. For example, the magnetizable particles may be coated with the surfactant. The surfactant is typically used in amounts less than 10% by weight relative to the weight of the silica. This typically translates to a concentration of less than 0.1% by weight of the fully formulated MR fluid. As the concentration of surfactant increases, the yield stress decreases. Yield stress is an indication of the strength of the silica network. While higher amounts of surfactant would be desirable, the amount of surfactant that may currently be used is limited due to its interference with the function of the thixotropic agent.

While the use of thixotropic agents and surfactants are effective to reduce the settling of the particles in MR fluids, they are not always sufficient to achieve the desired particle settling characteristics. Further, the use of these materials can also affect the magnetic response characteristics of the fluids, such as by reducing the magnetic saturation of the magnetizable particles.

Accordingly, it is desirable to provide MR fluids having suitable rheological and improved settling characteristics, while also maintaining the desired magnetic response characteristics of the magnetizable particles.

SUMMARY OF THE INVENTION

In one exemplary embodiment of the present invention, an MR fluid is provided, including a plurality of magnetizable particles having a particle density. The fluid also includes a carrier fluid having a fluid density, and the plurality of magnetizable particles is dispersed within the carrier fluid. A portion of the plurality of magnetizable particles has a particle density that is substantially the same as the fluid density.

In another exemplary embodiment of the present invention, an MR fluid includes a plurality of magnetizable particles having an outer shell of a magnetizable material and a hollow core. The fluid also includes a carrier fluid, the plurality of magnetizable particles being dispersed within the carrier fluid.

In yet another exemplary embodiment of the present invention, a MR fluid includes a plurality of magnetizable particles having an outer shell of a magnetizable material and an inner core, the inner core comprising a ceramic or polymer, or a combination thereof. The fluid also includes a carrier fluid, the plurality of magnetizable particles being dispersed within the carrier fluid.

The above features and advantages and other features and advantages of the present invention are readily apparent from the following detailed description of the best modes for carrying out the invention when taken in connection with the accompanying drawings.

BRIEF DESCRIPTION OF THE DRAWINGS

Other objects, features, advantages and details appear, by way of example only, in the following detailed description of embodiments, the detailed description referring to the drawings in which.

DESCRIPTION OF THE EMBODIMENTS

In accordance with an exemplary embodiment of the present invention, the use of magnetizable particles in an MR fluid having a particle density that is substantially the same as the density of the carrier fluid to significantly reduce or possibly eliminate particle settling in the MR fluid is disclosed. The particle density is altered by altering the structure of the particles, either by forming hollow particles of a magnetizable material, or by forming a shell of magnetizable material over a core of a material that is less dense than the magnetizable material, including various hollow cores and solid cores. Suitable cores may be magnetizable materials or non-magnetizable materials, so long as the core does not interfere with or otherwise substantially diminish the magnetic properties of the magnetizable shell. In another exemplary embodiment, the magnetizable particles may include a magnetizable shell over a hollow core, including spherical particles having a hollow core, further including those having a spherical hollow core. In yet another exemplary embodiment, the magnetizable particles may include a magnetizable outer shell having a solid inner core of a glass, polymer or ceramic material, or combination thereof, such as a core of a glass, polymer or ceramic microsphere.

Figure 1:
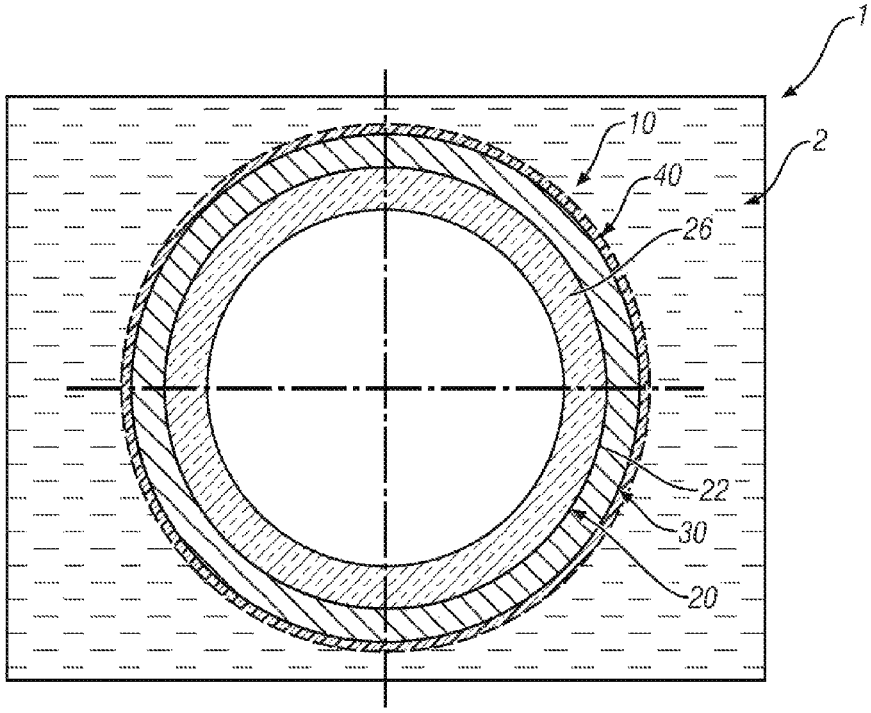
FIG. 1 is a schematic cross-sectional view of an exemplary embodiment of a magnetizable particle and MR fluid as disclosed herein.

Referring to FIG. 1, in accordance with an exemplary embodiment, an MR fluid 1 is disclosed. MR fluid 1 includes a carrier fluid 2 and a plurality of magnetizable particles 10. Carrier fluid 2 has a fluid density characteristic of the carrier fluids described herein below. The plurality of magnetizable particles 10 are dispersed within carrier fluid 2, any suitable dispersion may be used, including a homogenous dispersion of the particles in the fluid. Magnetizable particles 10 have a particle density that is substantially the same as the density of carrier fluid 2. In embodiments where carrier fluid 2 is a composite of fluids and other materials, including various rheology-modifying particulates, the density of carrier fluid 2 is a composite density of the carrier fluid, including all of the carrier constituents, i.e., all constituents other than the magnetizable particles. Magnetizable particles 10 have a density that is substantially the same as the density of carrier fluid 2 such that they may be dispersed within the fluid and have a substantially reduced tendency to settle. In the case where the particle density and density of carrier fluid 2 are equal, upon dispersion within the fluid the particles have substantially no tendency to settle out of carrier fluid 2, i.e., they form a stable or homogeneous suspension. However, complete identity of the density of magnetizable particles 10 and carrier fluid 2 is not required in order to obtain significant improvements in settling versus existing MR fluids where there is generally a substantial difference between the density of the magnetizable particles and that of the carrier fluid. Hence, the use of the phrase "substantially the same as" herein may include combinations of magnetizable particles 10 and carrier fluid 2 where there are minor differences in densities of these materials as much as 0 to about 20%, and more particularly a difference of about 0 to about 10%, and more particularly a difference of about 0 to about 5%. Each of the difference ranges described may provide a substantial improvement in settlement behavior over conventional MR fluids having substantially larger differences between the density of the magnetizable particles and the fluid density of the carrier fluid.

Referring again to FIG. 1, each of magnetizable particles 10 includes a core 20 that acts as a substrate for magnetizable material 30 that it is attached thereto. Core 20 includes a hollow core 22. Hollow core 22 may have any suitable hollow size and shape as described herein, including a hollow microsphere, as described herein. Hollow core 22 may include any suitable core material, including a hollow glass microsphere 26, polymer (not shown), or ceramic (not shown) material, or a combination thereof. Magnetizable material 30 may include any suitable magnetizable material including various paramagnetic, superparamagnetic, ferromagnetic or ferrimagnetic material, or a combination thereof. The magnetizable outer shell 30 may include any suitable magnetizable material, including various magnetizable pure metals and metal alloys as well as various ferrite materials, as described herein. Suitable magnetizable ferrites include Co, Fe, Mg, Mn, Ni or Zn ferrites, or a combination thereof. The magnetizable particle 10 may optionally also include an outer protective coating layer 40. Outer protective coating layer 40 may be formed of any suitable material, including a pure metal, metal alloy, ceramic, polymer or glass, or a combination thereof.

Figure 2:
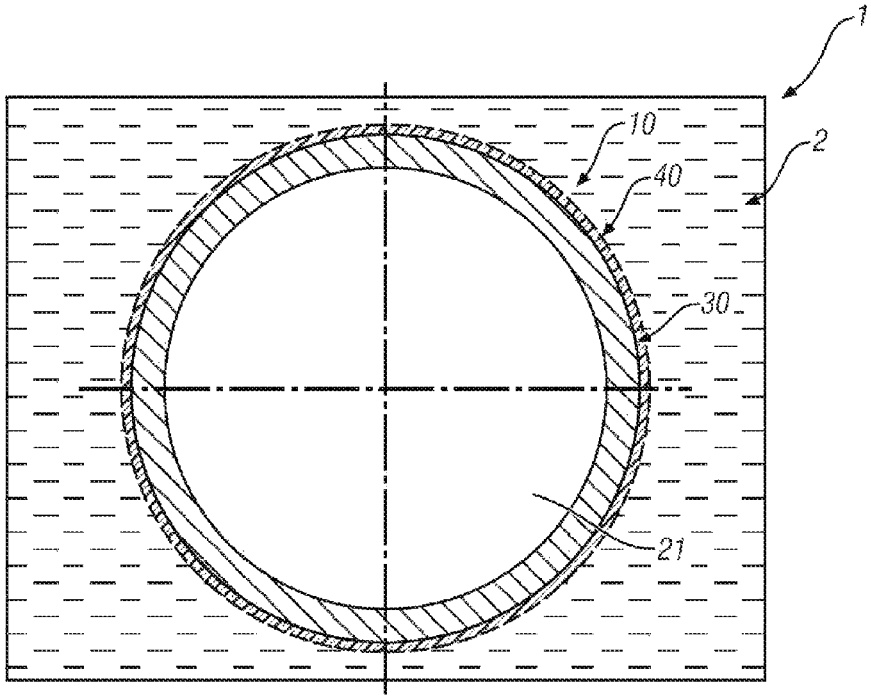
FIG. 2 is a schematic cross-sectional view of a second exemplary embodiment of a magnetizable particle and MR fluid as disclosed herein.

Referring to FIG. 2, in accordance with a second exemplary embodiment, an MR fluid 1 is disclosed. MR fluid 1 also includes a carrier fluid 2 and a plurality of magnetizable particles 10, as described above, and has the same density and dispersion characteristics. Magnetizable particles 10 also have a density that is substantially the same as the density of carrier fluid 2, as described above, such that they may be dispersed within the fluid and have a substantially reduced tendency to settle, as described herein.

Referring again to FIG. 2, each of magnetizable particle 10 do not have a core, but rather includes a hollow cavity 21 that is at least partially enclosed by magnetizable material 30, and more particularly may be fully enclosed by magnetizable material 30. Hollow cavity 21 may have any suitable hollow size and shape as described herein. Hollow cavity 21 may be formed, for example, by forming a particle of the types shown in FIG. 1 or 4 using a core 20 that includes a polymer and pyrolizing or otherwise removing the core polymer material leaving the outer shell 30 of the magnetizable material. Magnetizable material 30 may include any suitable magnetizable material including various paramagnetic, superparamagnetic, ferromagnetic or ferrimagnetic materials, or a combination thereof. Magnetizable outer shell 30 may be impervious to carrier fluid 22, or may be porous, and may also be sufficiently porous to enable carrier fluid 2 to partially fill or fill the cavity 21. As described with regard to the embodiment of FIG. 1, the magnetizable outer shell 30 may include any suitable magnetizable material, including various magnetizable pure metals and metal alloys as well as various ferrite materials, as described herein. Suitable magnetizable ferrites include Co, Fe, Mg, Mn, Ni or Zn ferrites, or a combination thereof. The magnetizable particle 10 may optionally also include an outer protective coating layer 40. Outer protective coating layer 40 may be formed of any suitable material, including a pure metal, metal alloy, ceramic, polymer or glass, or a combination thereof.

Figure 3:
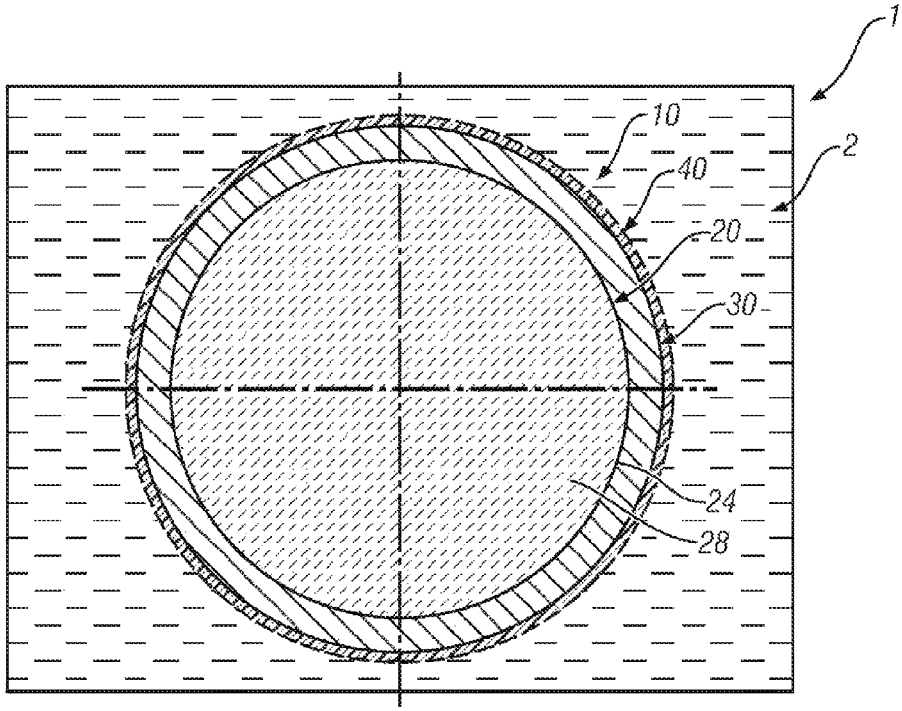
FIG. 3 is a schematic cross-sectional view of a third exemplary embodiment of a magnetizable particle and MR fluid as disclosed herein.

Referring to FIG. 3, in accordance with a third exemplary embodiment, an MR fluid 1 is disclosed. MR fluid 1 also includes a carrier fluid 2 and a plurality of magnetizable particles 10, as described above, and has the same density and dispersion characteristics. Magnetizable particles 10 also have a density that is substantially the same as the density of carrier fluid 2, as described above, such that they may be dispersed within the fluid and have a substantially reduced tendency to settle, as described herein.

Referring again to FIG. 3, each of magnetizable particles 10 includes a core 20 that acts as a substrate for magnetizable material 30 that it is attached thereto. Core 20 includes a solid core 24. Solid core 24 may have any suitable size and shape as described herein, including a solid microsphere, as described herein. Solid core 24 may include any suitable core material, including a solid glass microsphere 28, polymer (not shown), or ceramic material (not shown), or a combination thereof. Magnetizable material 30 may include any suitable magnetizable material including various paramagnetic, superparamagnetic, ferromagnetic or ferrimagnetic material, or a combination thereof. The magnetizable outer shell 30 may include any suitable magnetizable material, including various magnetizable pure metals and metal alloys as well as various ferrite materials, as described herein. Suitable magnetizable ferrites include Co, Fe, Mg, Mn, Ni or Zn ferrites, or a combination thereof. The magnetizable particle 10 may optionally also includes an outer protective coating layer 40. Outer protective coating layer 40 may be formed of any suitable material, including a pure metal, metal alloy, ceramic, polymer or glass, or a combination thereof.

Figure 4:
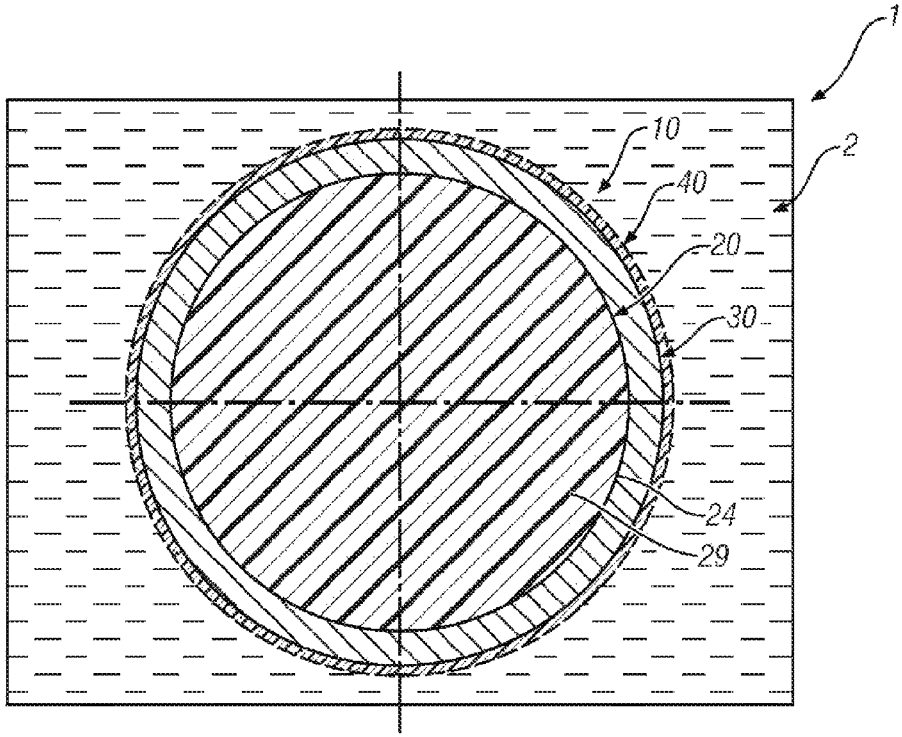
FIG. 4 is a schematic cross-sectional view of a fourth exemplary embodiment of a magnetizable particle and MR fluid as disclosed herein.

Referring to FIG. 4, in accordance with a fourth exemplary embodiment, an MR fluid 1 is disclosed. MR fluid 1 also includes a carrier fluid 2 and a plurality of magnetizable particles 10, as described above, and has the same density and dispersion characteristics. Magnetizable particles 10 also have a density that is substantially the same as the density of carrier fluid 2, as described above, such that they may be dispersed within the fluid and have a substantially reduced tendency to settle, as described herein.

Referring again to FIG. 4, each of magnetizable particles 10 includes a core 20 that acts as a substrate for magnetizable material 30 that it is attached thereto. Core 20 includes a solid core 24. Solid core 24 may have any suitable size and shape as described herein, including a solid microsphere, as described herein. Solid core 24 may include any suitable core material, including a solid glass microsphere 28 (see FIG. 3), solid polymer microsphere 29, or ceramic material (not shown), or a combination thereof. Magnetizable material 30 may include any suitable magnetizable material including various paramagnetic, superparamagnetic, ferromagnetic or ferrimagnetic material, or a combination thereof. The magnetizable outer shell 30 may include any suitable magnetizable material, including various magnetizable pure metals and metal alloys as well as various ferrite materials, as described herein. Suitable magnetizable ferrites include Co, Fe, Mg, Mn, Ni or Zn ferrites, or a combination thereof. The magnetizable particle 10 may optionally also includes an outer protective coating layer 40. Outer protective coating layer 40 may be formed of any suitable material, including a pure metal, metal alloy, ceramic, polymer or glass, or a combination thereof.

Figure 5:
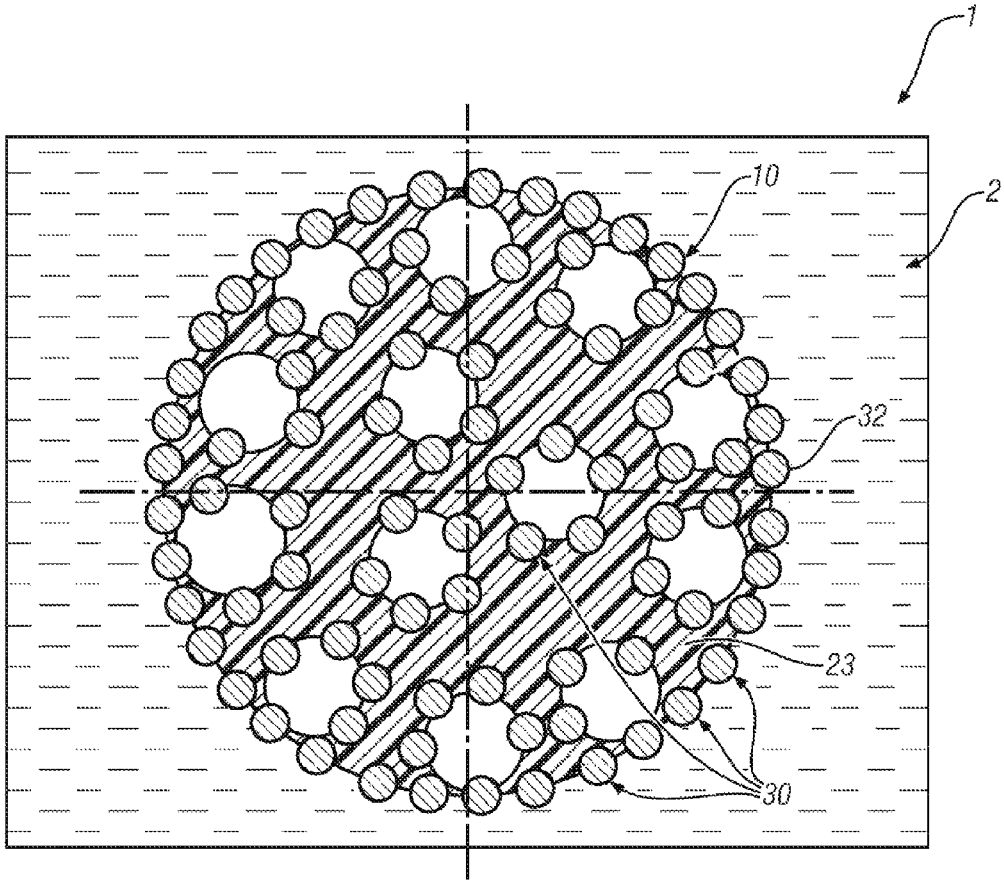
FIG. 5 is a schematic cross-sectional view of a fifth exemplary embodiment of a magnetizable particle and MR fluid as disclosed herein.

Referring to FIG. 5, in accordance with a fifth exemplary embodiment, an MR fluid 1 is disclosed. MR fluid 1 also includes a carrier fluid 2 and a plurality of magnetizable particles 10, as described above, and has the same density and dispersion characteristics. Magnetizable particles 10 also have a density that is substantially the same as the density of carrier fluid 2, as described above, such that they may be dispersed within the fluid and have a substantially reduced tendency to settle, as described herein.

Referring again to FIG. 5, each of magnetizable particles 10 includes a core 20 that acts as a matrix for magnetizable material 30 in the form of sub-particles 32 that are embedded therein. Core 20 may be a solid core (see generally FIGS. 3 and 4) or a multi-hollow or porous core 23. Multi-hollow or porous core 23 may have any suitable size and shape as described herein, including a microsphere, as described herein. Multi-hollow or porous core 23 may include any suitable core material, including a multi-hollow or porous polymer 23, glass (not shown), or ceramic (not shown) material, or a combination thereof. Magnetizable material 30 may include any suitable magnetizable material including various paramagnetic, superparamagnetic, ferromagnetic or ferrimagnetic material, or a combination thereof. The magnetizable material 30 and sub-particles 32 may include any suitable magnetizable material, including various magnetizable pure metals and metal alloys as well as various ferrite materials, as described herein. Sub-particles 32 may include nanometer size magnetizable particles. Suitable magnetizable ferrites include Co, Fe, Mg, Mn, Ni or Zn ferrites, or a combination thereof. The magnetizable particle 10 may optionally also includes an outer protective coating layer 40. Outer protective coating layer 40 may be formed of any suitable material, including a pure metal, metal alloy, ceramic, polymer or glass, or a combination thereof. An example of such magnetizable particles includes multi-hollow superparamagnetic magnetite/polystyrene nanocomposite microspheres, wherein the multi-hollow core comprises polystyrene and the sub-particles comprise magnetite ($Fe_3O_4$). Another example includes hollow glass microspheres having sub-particles or nanoparticles of $CoFe_2O_4$ embedded on an outer surface thereof.

The composition of the present MR fluid 1 is variable within certain ranges. In an exemplary embodiment, the solids content of the magnetically soft particles in the MR fluid is from about 5 to about 80 percent by volume (e.g., from about 29 to about 97 percent by weight for Fe), more preferably from about 20 to about 60 volume percent (e.g., from about 66 to about 92 percent by weight for Fe). As understood by those skilled in the art, the weight percentage will vary for different magnetic materials. Expressed in terms of weight percent, for many types of magnetizable materials, including magnetically soft compositions, the solids content of the magnetically soft particles in the MR fluid is preferably from about 20 to about 98 weight percent, more preferably from about 50 to about 95 weight percent. In an exemplary embodiment, the solids content of nanostructured additive particles in the liquid carrier phase is from about 0.1 to about 20 percent by weight, more particularly from about 1 to about 12 weight percent. The preferred polymer content in the MR fluid is from about 0.1 to about 10 percent by weight, more preferably from about 0.1 to about 1 weight percent. Additional solvents, if used, preferably comprise less than about 20 weight percent of the MR fluid.

Paramagnetic, superparamagnetic, ferromagnetic and ferrimagnetic materials have been employed as the magnetizable particles for use in magnetorheological liquids. In accordance with an exemplary embodiment, the magnetizable material used in the magnetizable particles 30 may include magnetically soft particles of magnetizable pure metals, metal alloys and metal compounds, including ferrites. These may include iron; nickel; cobalt; iron oxide; gamma iron oxide; iron cobalt alloys, iron nickel alloys, iron silicon alloys, various ferrites, including ferrites of Co, Fe, Mg, Mn, Ni or Zn, or combinations thereof, and more particularly manganese zinc ferrites and zinc nickel ferrites; chrome oxide, iron nitride; vanadium alloys, tungsten alloys, copper alloys, manganese alloys, and any other suitable magnetically soft particles. In one embodiment, the soft magnetic particles typically have an average particle size from about 1 to about 100 microns, more particularly from about 1 to about 20 microns.

As noted, magnetizable particles in the sense of the present invention may include any suitable magnetizable material, including paramagnetic, superparamagnetic, ferromagnetic and ferrimagnetic materials. The following can be cited as examples: iron, iron nitride, iron carbide, steel of carbon content lower than 1%, nickel and cobalt. Mixtures of these materials are also suitable, as are alloys of iron with aluminum, silicon, cobalt, nickel, vanadium, molybdenum, chromium, tungsten and manganese. Iron-nickel alloys and iron-cobalt alloys can be cited as alloys which are well suited for this purpose. Magnetic oxides of chromium and iron are also suitable, such as chromium dioxide, gamma-$Fe_2O_3$ and $Fe_3O_4$. Iron and/or iron alloys are the preferred magnetizable particles in this connection. The magnetizable particles may be selected from metal particles that are mechanically soft and easily compressible and which exhibit lower abrasion and wear to component surfaces. In this regard carbonyl iron which includes small spherical iron particles that are obtained by the thermal decomposition of iron (0) pentacarbonyl, is particularly suitable. The magnetizable particles that result from reduced carbonyl iron are mechanically soft and easily compressible metal particles having a nominal particle size of about 6-9 microns and a hardness of about B50 on the Rockwell scale (generally equivalent to the hardness of brass). Typical grades of soft, reduced carbonyl iron available commercially are CL, CM, CS, CN, SP, SQ, SL, SD, SB, and SM grades manufactured by BASF, and the R-2430, R-2410, R-1510, R-1470, R-1430, R-1521, and R-2521 grades manufactured by ISP Technologies, Inc. These iron particles are magnetically soft, i.e., they magnetize under a magnetic field, but they lose their magnetism when the magnetic field is turned off. This soft magnetism allows chain formation and breakage, thus providing reversible off-state and on-state properties.

It has been found that magnetorheological particulate materials such as carbonyl iron treated to incorporate integrated nitrogen exhibit elevated oxidation resistance. Without being bound to any theory, it is believed that the presence of even small percentages of integrated nitrogen can act to retard oxidative processes associated with MR fluid usage providing enhanced particulate oxidation resistance and more robust magnetic performance. The nitrogen-rich particles can constitute all or a portion of the particulate component of the MR fluid. The quantity of treated or nitrogen-rich MR particles employed will be that which maintains the magnetorheological responsiveness of the associated MR fluid within desired parameters.

The MR particles can be either monomodal or bimodal in particulate distribution. The term "bimodal" is employed to mean that the population of solid particles employed in the fluid possesses two distinct maxima in their size or diameter. The bimodal particles may be spherical or generally spherical. In bimodal compositions, it is contemplated that the particles will be in two different size populations—a small diameter size and a large diameter size. The large diameter size particle group will have a large mean diameter size with a standard deviation no greater than about two-thirds of the overall mean diameter size. Likewise, the smaller particle group will have a small mean diameter size with a standard deviation no greater than about two-thirds of the overall mean diameter value.

In one embodiment the small particles are at least one micron in diameter so that they are suspended and function as magnetorheological particles. The practical upper limit on particle size is about 100 microns since particles of greater size usually are not spherical in configuration but tend to be agglomerations of other shapes. However, for the practice of the embodiments disclosed herein, the mean diameter or most common size of the large particle group preferably is 5 to 10 times the mean diameter or median particle size in the small particle group. The weight ratio of the two groups may be within 0.1 to 0.9. The composition of the large and small particle groups may be the same or different. Carbonyl iron particles are preferred. Such materials typically have a spherical configuration and work well for both the small and large particle groups.

In MR fluids for use in high temperature applications, it is anticipated that at least a portion of particles that are more readily oxidized will be treated to provide nitrogen diffusion regions. In bimodal MR fluid compositions, it is contemplated that at least a portion of one particle class will be treated with nitrogen. In bimodal MR fluids, it is preferred that at least a portion of particles having small average particle distribution sizes will be treated prior to integration into the MR carrier fluid.

The magnetizable particles 10 may have any suitable size and shape. The average longest dimension based on their weight (weight average) of the magnetizable particles according to the invention which are coated with an organic polymer is preferably 0.1 to 100 μm, most preferably 1 to 50 μm.

The shape of the magnetizable particles may be irregular, rod-like or acicular. A spherical shape or a shape similar to a spherical shape is particularly preferred if the object is to achieve high degrees of filling.

Any solid which is known to exhibit magnetorheological activity can be used, specifically including paramagnetic, superparamagnetic and ferromagnetic elements and compounds. Examples of suitable magnetic-responsive particles include iron, iron alloys (such as those including aluminum, silicon, cobalt, nickel, vanadium, molybdenum, chromium, tungsten, manganese and/or copper), iron oxides (including $Fe_2O_3$ and $Fe_3O_4$, iron nitride, iron carbide, carbonyl iron, nickel, cobalt, chromium dioxide, stainless steel and silicon steel. Examples of suitable particles include straight iron powders, reduced iron powders, iron oxide powder/straight iron powder mixtures and iron oxide powder/reduced iron powder mixtures. A preferred magnetic-responsive particulate is carbonyl iron, preferably reduced iron carbonyl.

The particle size should be selected so that it exhibits multi-domain characteristics when subjected to a magnetic field. In one exemplary embodiment, average particle diameter sizes for the magnetizable particles 10 is generally between about 0.1 and about 1000 μm, more particularly between about 0.1 and about 500 μm, and more particularly between about 1.0 and about 10 μm, and are preferably present in an amount between about 50 and 90 percent by weight of the total composition.

It is believed that the magnetizable materials described herein, such as carbonyl iron, may be deposited on cores 20 of particles of the types described herein. Deposition of the magnetizable material 30 may be performed using any suitable deposition method, including various forms of plating, CVD, PVD and the like.

An MR fluid 1 will include at least a portion of particles having a hollow cavity 21 or core 20, as described herein. MR fluid 1 may also include a portion of conventional solid magnetizable particles that do not include a hollow cavity or core. In such mixtures, the portion of conventional particles will have a tendency to settle, as described herein; however, the portion of particles having a hollow cavity 21 or core 20, as described herein will provide improved resistance to settling versus a conventional MR fluid that consists entirely of conventional solid magnetizable particles.

Magnetizable particles 10 may also, optionally, be coated with various polymer coatings, including various gelatines. In this connection, the term "gelatine" comprises gelatine coacervates and gelatine-like complex coacervates. Combinations of gelatine with synthetic polyelectrolytes are particularly preferred as complex coacervates containing gelatine. Suitable synthetic polyelectrolytes are those which are produced by the homo- or copolymerisation of maleic acid, acrylic acid, methacrylic acid, acrylamide and methacrylamide, for example. The term "gelatine" also comprises gelatine which is further crosslinked with customary hardeners, such as formaldehyde or glutaraldehyde, for example.

The following can be cited as suitable synthetic polymers: polyesters, polyurethanes, particularly polyester urethanes and polyether urethanes, polycarbonates, polyester-polycarbonate copolymers, polyureas, melamine resins, polysiloxanes, fluoropolymers and vinyl polymers. The following can be cited as examples of suitable vinyl polymers: polyvinyl chloride, polyvinyl esters such as polyvinyl acetate for example, polystyrene, polyacrylic esters such as polymethyl methacrylate, polyethyl hexyl acrylate, polylauryl methacrylate, polystearyl methacrylate or polyethyl acrylate for example, and polyvinyl acetals such as polyvinyl butyral. Other suitable synthetic polymers include co- or terpolymers of different vinyl and vinylidene monomers, such a polystyrene-co-acrylonitrile for example, and copolymers of (meth) acrylic acid and (meth)acrylic esters. Vinyl polymers, polyureas and/or polyurethanes are the organic polymers which are particularly preferred in this respect.

The carrier fluid 2 may include any suitable carrier fluid. The carrier fluid 2 will generally include a solvent. The carrier fluid may optionally also include various anti-settling agents. These anti-settling agents may be described as thixotropic agents, surfactants, dispersants, thickeners, rheology modifiers, anti-wear agents and the like.

The MR fluid 1 may include any suitable solvent, including various organic liquids. Polar organic liquids are one type of organic liquid that may be used. In one embodiment, the solvent has a relatively high boiling point so that the solvent does not evaporate in use. Suitable solvents include MR carrier fluids known in the art such as ethylene glycol, ethylene glycol ethers, mineral oils, machine oils, silicone oils and the like. In an exemplary embodiment, the solvent may include from about 1 to about 50 weight percent of the MR fluid, more particularly from about 4 to about 15 weight percent. In another exemplary embodiment, the solvent is substantially free of water.

The MR fluid may according to another exemplary embodiment contain as the carrier liquid, mineral oils, paraffin oils, hydraulic oils, what are termed transformer oils which contain chlorinated aromatic compounds and which are characterized by their highly insulating properties and high temperature-resistance, as well as various chlorinated and fluorinated oils. Silicone oils, fluorinated silicone oils, polyethers, fluorinated polyethers and polyether-polysiloxane copolymers also may be employed. In an exemplary embodiment, the viscosity of the carrier liquid is about 1 to 1000 mPa, more particularly about 3 to 800 mPa, as measured at 25° C.

The carrier fluids can be any organic fluid, more particularly a non-polar organic fluid, where the carrier fluid forms the continuous phase of the MR fluid. Examples of suitable fluids include silicone oils, mineral oils, castor oil including commercially available low viscosity castor oil, paraffin oils, silicone copolymers, white oils, hydraulic oils, transformer oils, halogenated organic liquids (such as chlorinated hydrocarbons, halogenated paraffins, perfluorinated polyethers and fluorinated hydrocarbons), diesters, polyoxyalkylenes, fluorinated silicones, cyanoalkyl siloxanes, glycols, and synthetic hydrocarbon oils (including both unsaturated and saturated). A mixture of these fluids may also be used as the carrier component of the magnetorheological fluid. The preferred carrier fluid is non-volatile, non-polar and does not include any significant amount of water. Preferred carrier fluids are synthetic hydrocarbon oils, particularly those oils derived from high molecular weight alpha olefins of from 8 to 20 carbon atoms by acid catalyzed dimerization and by oligomerization using trialuminum alkyls as catalysts. Poly-$\alpha$-olefin is a particularly preferred carrier fluid.

In an exemplary embodiment, the viscosity of the carrier component is preferably between about 1 to about 100,000 centipoise at room temperature, more particularly between about 1 to about 10,000 centipoise, and, more particularly between about 1 and about 1,000 centipoise.

In yet another exemplary embodiment, the carrier fluid may be a water-based or aqueous fluid. In one embodiment, water alone can be used. However, small (less than about 5% by weight of the total formulation, and more particularly about 0.1 to about 5% by volume) amounts of polar, water-miscible organic solvents such as methanol, ethanol, propanol, dimethyl sulfoxide, dimethyl formamide, ethylene carbonate, propylene carbonate, acetone, tetrahydrofuran, diethyl ether, ethylene glycol, propylene glycol and the like can be added.

Any suitable anti-settling agent may be employed. Suitable anti-settling agents will include materials that do not degrade or diminish the performance of the magnetizable particles 30 and are compatible with carrier fluid. These include various thixotropic agents dispersed within the solvent. Thixotropic agents include fumed or precipitated silica. When used with a suitable solvent, silicas can stabilize the MR fluid by forming a network through hydrogen bonding between silica particles. This network breaks down under shear and reforms upon cessation of shear to keep the magnetizable particles suspended while exhibiting low viscosity under shear. Precipitated silica typically has a large particle size and low surface area due to its method of formation, whereas fumed silicas are typically smaller in size with larger surface area. Fumed silicas, when used, are typically surface treated. Both precipitated silicas and treated fumed silicas, however, often exhibit poor network formation, and consequently low yield stresses in the MR fluid during operation.

MR fluids may additionally contain surfactants to prevent coagulation and settling of the magnetizable particles. For example, the magnetizable particles may be coated with the surfactant. The surfactant is typically used in amounts less than 10% by weight relative to the weight of the silica. This typically translates to a concentration of less than 0.1% by weight of the fully formulated MR fluid. As the concentration of surfactant increases, the yield stress decreases. Yield stress is an indication of the strength of the silica network. While higher amounts of surfactant would otherwise be desirable, the amount of surfactant that may currently be used is limited due to its interference with the function of the thixotropic agent.

While the use of thixotropic agents and surfactants are effective to reduce the settling of the particles in MR fluids, they are not always sufficient to achieve the desired particle settling characteristics. Further, the use of these materials can also affect the magnetic response characteristics of the fluids, such as by reducing the magnetic saturation of the magnetizable particles.

MR fluid 1 may also include in carrier fluid 2 a thickener. In an exemplary embodiment, the MR fluids according to the invention additionally contain at least one thickener which imparts thixotropic properties to the magnetorheological liquid and increases the stability of the suspension of magnetizable particles 30 with regard to settling. Examples of thickeners include finely divided inorganic or organic microparticles, including gels, silicates such as bentonite, metal oxides such as titanium dioxide, alumina or silica, and/or microdispersed hydrated silicas obtained by flame hydrolysis, which are commercially available under the trade names Aerosil® or HDK® from Degussa AG, Germany and from Wacker GmbH, Germany, respectively.

MR fluid 1 may also include in carrier fluid 2 various additive particles as a thixotropic agent. These may include nanostructured materials such as oxides, carbides, nitrides and borides. Oxide additive particles are suitable for many of the present MR fluids, including, for example, $SiO_2$, $TiO_2$, $ZrO_2$, and $Fe_3O_4$. The additive particles are capable of being linked by polymers, and typically have an average particle size substantially smaller than the size of the magnetically soft particles. The additive particles may have an average size from about $10^{-5}$ of to about the average size of the soft magnetic particles. The average particle size of the additive particles is typically from about 1 to about 1,000 nm, more particularly from about 1 to about 100 nm, with a particle size of from about 10 to about 20 nm being suitable for many applications. The weight ratio of the additive particles to the magnetically soft particles is typically about 0.004 to about 0.4, more particularly from about 0.01 to about 0.05.

Hydrophobic organoclays may also be used in the fluid compositions described herein as anti-settling agents, thickening agents and rheology modifiers. They increase the viscosity and yield stress of the magnetorheological fluid compositions described herein. When used, the organoclays are typically present in concentrations of between about 0.1 to about 6.5, more particularly, about 3 to about 6, weight percent, based on the weight of the total composition.

The hydrophobic organoclay provides for soft sediment in the event any of the magnetizable particles settle out. The soft sediment provides for ease of re-dispersion. Suitable clays are thermally, mechanically and chemically stable and have a hardness less than that of conventionally used anti-settling agents such as silica or silicon dioxide. Compositions of the invention described herein preferably shear thin at shear rates less than 100/sec, and recover their structure after shear thinning in less than about five minutes.

Organoclays suitable for use in the MR fluid compositions described herein are typically derived from bentonites. Bentonite clays tend to be thixotropic and shear thinning, i.e., they form networks which are easily destroyed by the application of shear, and which reform when the shear is removed. As used herein, "derived" means that a bentonite clay material is treated with an organic material to produce the organoclay. Bentonite, smectite and montmorillonite are sometimes used interchangeably. However, as used herein, "bentonite" denotes a class of clays that include smectite clays, montmorillonite clays and hectorite clays. Montmorillonite clay typically constitutes a large portion of bentonite clays. Montmorillonite clay is an aluminum silicate. Hectorite clay is a magnesium silicate.

The clays are modified with an organic material to replace the inorganic surface cations with organic surface cations via conventional methods (typically a cation exchange reaction). Examples of suitable organic modifiers include amines, carboxylates, phosphonium or sulfonium salts, or benzyl or other organic groups. The amines can be, for example, quaternary or aromatic amines.

It is believed that organoclays orient themselves in an organic solution via a similar mechanism as that involved with clays in aqueous solutions. However, there are fundamental differences between the two. For example, oils cannot solvate charges as well as aqueous solutions. The gelling properties of organoclays depend largely on the affinity of the organic moiety for the base oil. Other important properties are the degree of dispersion and the particle/particle interactions. The degree of dispersion is controlled by the intensity and duration of shear forces, and sometimes by the use of a polar activator. The particle/particle interactions are largely controlled by the organic moiety on the surface of the clay.

MR fluid 1 may also include in carrier fluid 2 a suitable dispersing agent or agents. In another exemplary embodiment, MR fluid 1 according to the invention includes a dispersing agent or agents. Examples of suitable dispersing agents include lecithin, oleic acid and oleates such as iron oleate, fatty acids, alkali soaps such as lithium stearate, sodium stearate or aluminum tristearate, sulphonates and phosphonates containing lipophilic radicals, and glycerol esters such as glycerol monostearate. When used, the dispersing agent may be present in an amount of about 0.01 to about 2% by weight, more particularly about 0.1 to about 0.5% by weight, with respect to the weight of magnetizable particles.

MR fluid 1 may also include in carrier fluid 2 a suitable anti-wear or anti-friction agent, or a combination thereof. In another exemplary embodiment, a MR fluid 1 according to the invention includes an additive that imparts anti-wear and anti-friction properties to the fluid. Any suitable anti-wear agent may be used, including various colloidal additives, such as colloidal polytetrafluoroethylene, colloidal graphite or colloidal molybdenum disulfide, and a combination or mixture thereof. Additional antiwear additives include, for example, engine lubricants, such as those that incorporate thiophosphorus or thiocarbamate, including zinc dialkyl dithiophosphate (ZDDP).

In another exemplary embodiment, an MR fluid 1 according to the invention may also contain a lubricative additive, including at least one of polytetrafluoroethylene, graphite or molybdenum disulfide. Furthermore, the additive has a particle size equal to or less than 10 microns such that the ability of the additive to lubricate the magnetizable particles is optimized.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiments disclosed as the best mode contemplated for carrying out this invention, but that the invention will include all embodiments falling within the scope of the present application.

What is claimed is:

1. A magnetorheological fluid, comprising:

a plurality of magnetizable particles having a particle density, a portion of the magnetizable particles comprising a porous shell of a magnetizable material; and a carrier fluid having a fluid density, the plurality of magnetizable particles dispersed within the carrier fluid, a portion of the plurality of magnetizable particles having a particle density that is substantially the same as the fluid density.

2. The magnetorheological fluid of claim 1, wherein the portion of the magnetizable particles comprising the porous shell have a hollow inner cavity.

3. The magnetorheological fluid of claim 2, wherein the portion of the magnetizable particles comprising the porous shell are substantially spherical.

4. The magnetorheological fluid of claim 1, wherein the portion of the magnetizable particles comprising the porous shell have an inner core.

5. The magnetorheological fluid of claim 4, wherein the inner core comprises a ceramic, glass or polymer, or a combination thereof.

6. The magnetorheological fluid of claim 4, wherein the inner core comprises a matrix having plurality of magnetizable sub-particles dispersed therein.

7. The magnetorheological fluid of claim 6, wherein the matrix comprises a ceramic, glass or polymer, or a combination thereof.

8. The magnetorheological fluid of claim 6, wherein the matrix is porous.

9. The magnetorheological fluid of claim 1, wherein the magnetizable material comprises a paramagnetic, superparamagnetic, ferromagnetic or ferrimagnetic material, or a combination thereof.

10. The magnetorheological fluid of claim 1, wherein the magnetizable material comprises a ferrite.

11. The magnetorheological fluid of claim 10, wherein the ferrite comprises Co, Fe, Mg, Mn, Ni or Zn, or a combination thereof.

12. The magnetorheological fluid of claim 2, wherein the porous shell of the magnetizable material is configured such that the carrier fluid may permeate the cavity.

13. A magnetorheological fluid, comprising:

a plurality of magnetizable particles having a porous outer shell of a magnetizable material and an inner core, the inner core comprising a ceramic, glass or polymer, or a combination thereof; and a carrier fluid, the plurality of magnetizable particles dispersed within the carrier fluid.

14. The magnetorheological fluid of claim 13, wherein the inner core comprises one of a solid core or a hollow core.

15. The magnetorheological fluid of claim 13, wherein the magnetizable particles comprise a ferrite.

16. The magnetorheological fluid of claim 15, wherein the ferrite comprises Co, Fe, Mg, Mn, Ni or Zn, or a combination thereof.

17. A method of making an MR fluid, comprising:

forming a carrier fluid configured to receive a plurality of magnetizable particles, the carrier fluid having a fluid density;

forming the plurality of magnetizable particles having a particle density; a portion of the magnetizable particles comprising a porous shell of a magnetizable material, the magnetizable particles having a particle density that is substantially the same as the fluid density; and dispersing the magnetizable particles in the carrier fluid.

18. The method of claim 17, wherein forming the plurality of magnetizable particles comprises for each of the plurality of particles, depositing a layer of a porous magnetizable material as an outer shell over a hollow or a solid inner core comprising a glass, a polymer or a ceramic, or a combination thereof.

19. The method of claim 18, further comprising removing the inner cores to produce a plurality of magnetizable particles, wherein the magnetizable particles comprise an outer shell and an inner cavity.

20. The method of claim 17, wherein forming the plurality of magnetizable particles comprises for each of the plurality of particles, forming a plurality of sub-particles of the magnetizable material and a matrix comprising a glass, a polymer or a ceramic, or a combination thereof, wherein the sub-particles are embedded in the matrix.

* * * * *